US011142003B2

(12) United States Patent
Pohlt

(10) Patent No.: US 11,142,003 B2
(45) Date of Patent: Oct. 12, 2021

(54) METHOD AND SYSTEM FOR REDUCING THE UNDULATION OF A RECORDING MEDIUM

(71) Applicant: Océ Holding B.V., Venlo (NL)

(72) Inventor: Michael Pohlt, Munich (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/563,006

(22) Filed: Sep. 6, 2019

(65) Prior Publication Data

US 2020/0079122 A1 Mar. 12, 2020

(30) Foreign Application Priority Data

Sep. 6, 2018 (DE) ..... 10 2018 121 758.7

(51) Int. Cl.

| | |
|---|---|
| ***B41J 15/16*** | (2006.01) |
| ***B41J 11/00*** | (2006.01) |
| ***B41J 13/00*** | (2006.01) |

(52) U.S. Cl.

CPC ..... *B41J 15/165* (2013.01); *B41J 11/002* (2013.01); *B41J 11/0005* (2013.01); *B41J 13/0009* (2013.01)

(58) Field of Classification Search

CPC .... B41J 15/165; B41J 11/0005; B41J 11/002; B41J 13/0009

See application file for complete search history.

(56) References Cited

U.S. PATENT DOCUMENTS

2012/0013671 A1* 1/2012 Houjou ..... B41J 11/002 347/16

FOREIGN PATENT DOCUMENTS

| | | |
|---|---|---|
| EP | 2 407 310 A2 | 1/2012 |
| EP | 2 631 079 A1 | 8/2013 |
| EP | 3 012 110 A1 | 4/2016 |

OTHER PUBLICATIONS

German action dated Jul. 1, 2019, for Application No. 10 2018 121 758.7.

* cited by examiner

*Primary Examiner* — Geoffrey S Mruk

(74) *Attorney, Agent, or Firm* — Schiff Hardin LLP

(57) ABSTRACT

In methods and systems for reducing the undulation of a recording medium that has been printed to in an inkjet printer, operating parameters—such as the applied drying energy and/or the web tension of the recording medium during the drying of the recording medium—are set or adapted for or during the printing operation in order to reduce the undulation of the printed and dried recording medium.

18 Claims, 3 Drawing Sheets

METHOD AND SYSTEM FOR REDUCING THE UNDULATION OF A RECORDING MEDIUM

CROSS REFERENCE TO RELATED APPLICATIONS

This patent application claims priority to German Patent Application No. 102018121758.7, filed Sep. 6, 2018, which is incorporated herein by reference in its entirety.

BACKGROUND

Field

The disclosure relates to methods with which the undulation of a recording medium printed to in an inkjet printer may be reduced, and if possibly may be avoided entirely.

Related Art

Inkjet printing devices may be used for printing to recording media (such as paper, for example). For this purpose, one or more nozzles are used in order to fire ink droplets onto the recording medium, and thus to generate a desired print image on the recording medium.

An inkjet printing device may comprise one or more dryers in order to dry the recording medium after application of the print image, and in order to thereby fix the applied ink onto the recording medium. A dryer may have a drying route with one or more drying modules. The individual drying modules may be set up to blow a heated, gaseous drying medium, in particular air, onto the surface of the recording medium in order to dry said recording medium. The drying modules may thereby be arranged along the drying route such that the recording medium does not come into contact with the drying modules and floats through the dryer.

A recording medium, in particular paper, is typically substantially mechanically modified by the moistening with ink and by the subsequent drying. In particular, the moistening with ink and the subsequent drying may have the effect that the recording medium is no longer flat after the drying. This is disadvantageous, in particular for applications such as book printing. After longer periods of time, the printed and dried recording medium also no longer returns to flatness.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1A:
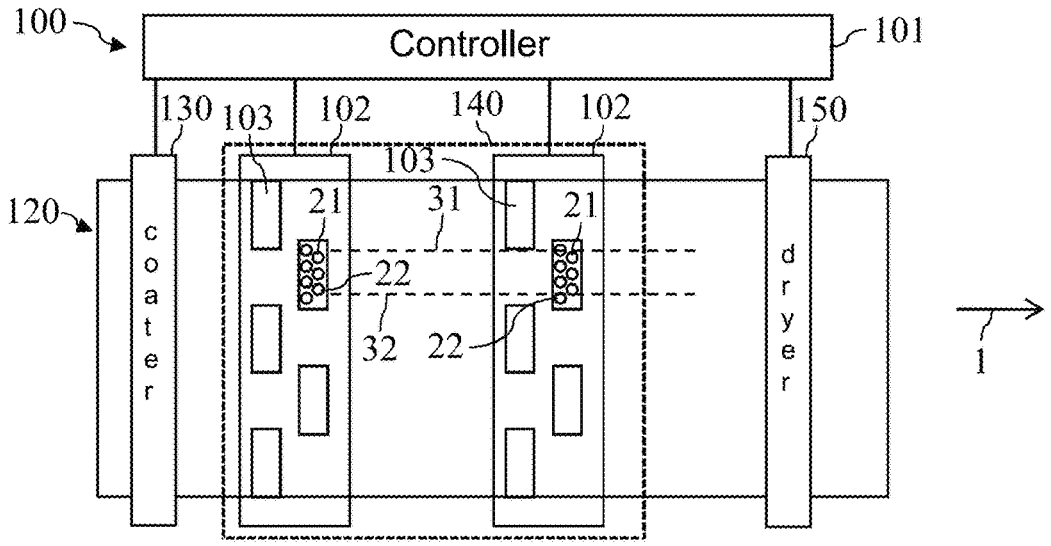

FIG. 1*a* illustrates a block diagram of an inkjet printer having a dryer according to an exemplary embodiment of the present disclosure.

Figure 1B:
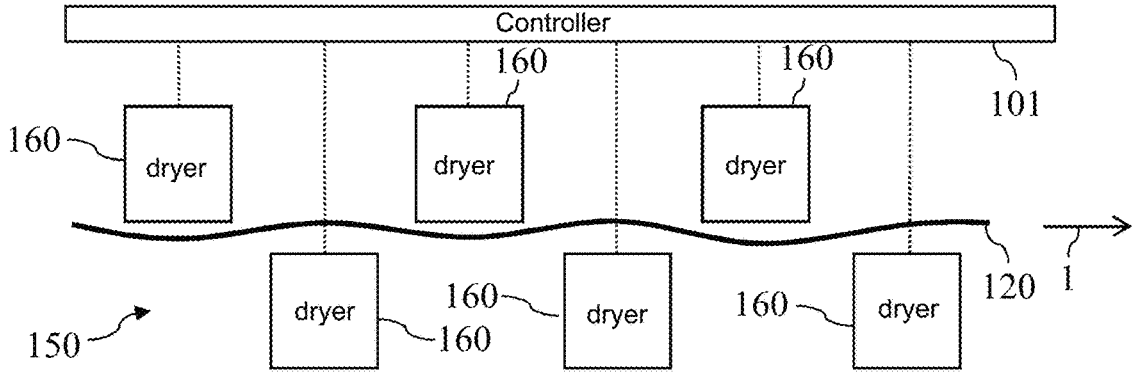

FIG. 1*b* illustrates a block diagram of an example of a dryer for an inkjet printer according to an exemplary embodiment of the present disclosure.

Figure 1C:
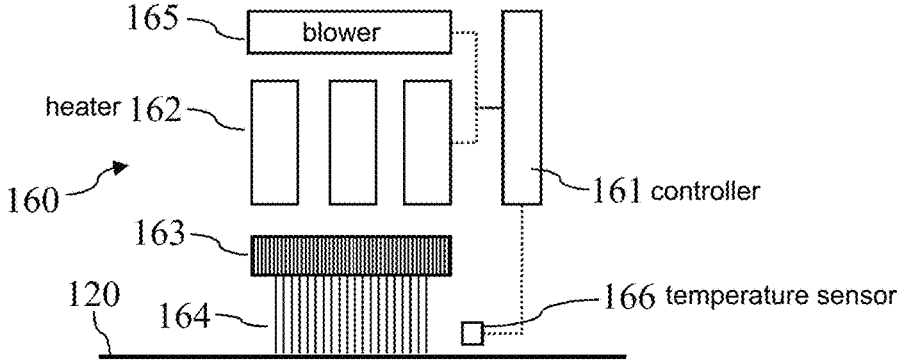

FIG. 1*c* illustrates a block diagram of a dryer element for a dryer according to an exemplary embodiment of the present disclosure.

Figure 2A:
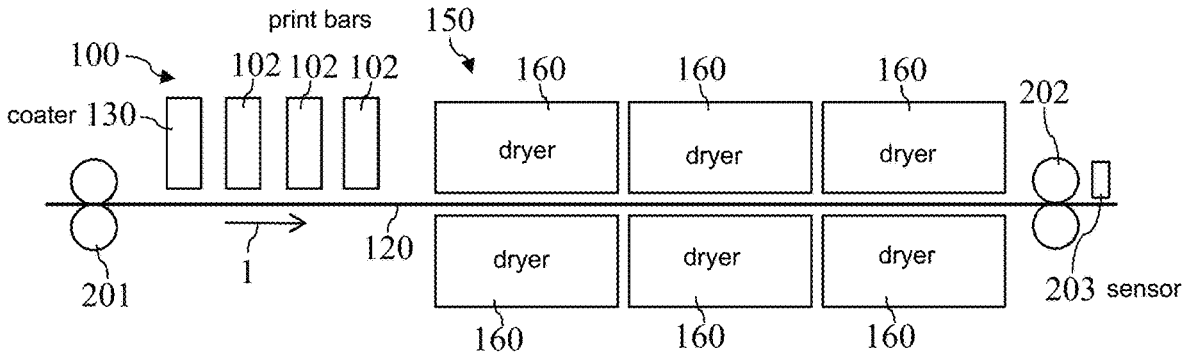

FIG. 2*a* illustrates an inkjet printer having different components for influencing the undulation of a printed and dried recording medium according to an exemplary embodiment of the present disclosure.

Figure 2B:
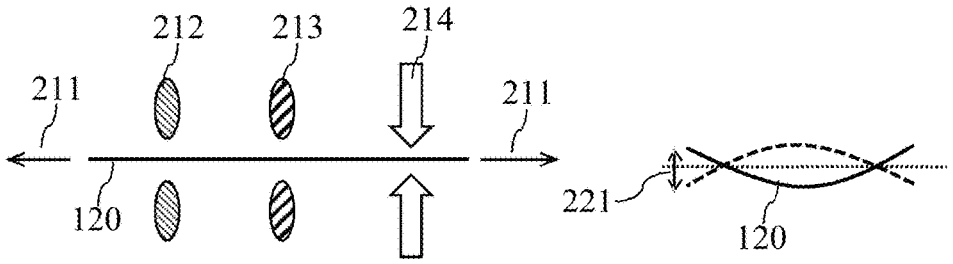

FIG. 2*b* illustrates examples of parameters for influencing the undulation of a printed and dried recording medium according to an exemplary embodiment of the present disclosure.

Figure 3A:
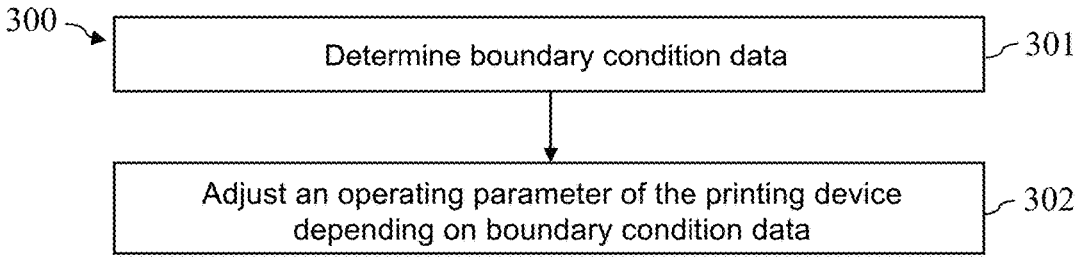

FIG. 3*a* illustrates a flowchart of a method for reducing the undulation of a printed and dried recording medium according to an exemplary embodiment of the present disclosure.

Figure 3B:
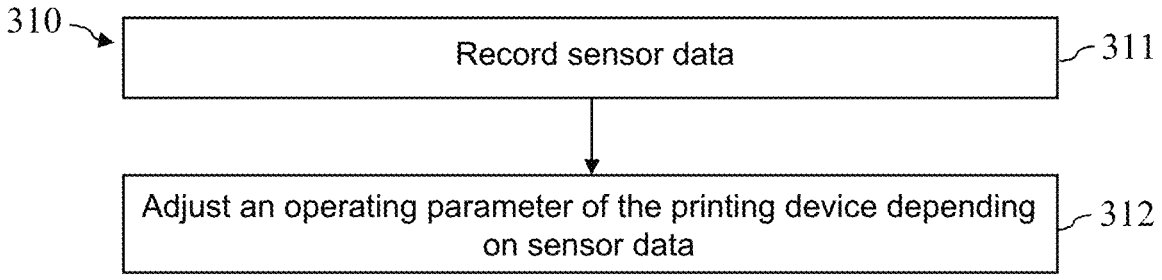

FIG. 3*b* illustrates a flowchart of a method for reducing the undulation of a printed and dried recording medium according to an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

According to one aspect of the present disclosure, a method is described for reducing the undulation of a recording medium that has been printed to and dried by an inkjet printer. In an exemplary embodiment, the method includes the determination of boundary condition data, where the boundary condition data indicate a property of the recording medium, and/or of a print image that is printed onto the recording medium, or is to be printed onto the recording medium. In an exemplary embodiment, the method further includes the setting of at least one operating parameter of the printer for the printing operation, depending on the boundary condition data, in order to reduce the undulation, or with the goal of reducing the undulation, of the recording medium printed to and dried during the printing operation.

According to another aspect of the disclosure, a method is described for reducing the undulation of a recording medium that has been printed to and dried by an inkjet printer. In an exemplary embodiment, the method includes the recording of sensor data with regard to the printed and dried recording medium. In an exemplary embodiment, the method includes the adaptation of at least one operating parameter of the printer during the printing operation, depending on the sensor data, in order to reduce the undulation, or with the goal of reducing the undulation, of the recording medium printed to and dried during the printing operation.

FIG. 1*a* illustrates a printer 100 according an exemplary embodiment. In an exemplary embodiment, the printer 100 is configured to print a recording medium 120 in the form of, for example, a sheet, page, plate, or band. The recording medium 120 may have been produced from, for example, paper, paperboard, cardboard, metal, plastic, textiles, a combination thereof, and/or other materials that are suitable and can be printed to. The recording medium 120 is directed along the transport direction 1 (represented by an arrow) through the print group 140 of the printer 100.

In the depicted example, in an exemplary embodiment, the print group 140 of the printer 100 includes two print bars 102, where each print bar 102 may be used for printing with ink of a defined color (for example black, cyan, magenta, and/or yellow, and Magnetic Ink Character Recognition (MICR) ink if applicable). Different print bars 102 may be used for printing with respective different inks. Furthermore, the printer 100 includes at least one fixing or dryer 150 that is configured to fix or dry a print image printed onto the recording medium 120. Moreover, the printer 100 may include at least one coater 130 that is configured to apply a coating substance, in particular a primer, onto the recording medium 120 in preparation for the printing of a print image. The coating substance may, for example, be applied by means of a print bar 102 with one or more print heads 103 (analogous to ink).

A print bar 102 may include one or more print heads 103 that are, if applicable, arranged side by side in multiple rows in order to print the dots of different columns 31, 32 of a print image onto the recording medium 120. In the example depicted in FIG. 1*a*, a print bar 102 includes five print heads 103, wherein each print head 103 prints the dots of a group of columns, 31, 32 of a print image onto the recording medium 120.

In the embodiment depicted in FIG. 1*a*, each print head 103 of the print group 140 includes a plurality of nozzles 21, 22, wherein each nozzle 21, 22 is configured to fire or eject ink droplets onto the recording medium 120. A print head 103 of the print group 140 may, for example, include multiple thousands of effectively utilized nozzles 21, 22 that are arranged along multiple rows, transversal to the transport direction 1 of the recording medium 120. By means of the nozzles 21, 22 of a print head 103 of the print group 140, dots of a line of a print image may be printed onto the recording medium 120 transversal to the transport direction 1, meaning along the width of the recording medium 120.

In an exemplary embodiment, the printer 100 also includes a controller 101, for example an activation hardware and/or a processor, that is configured to activate the actuators of the individual nozzles 21, 22 of the individual print heads 103 of the print group 140 in order to apply the print image onto the recording medium 120 depending on print data. In an exemplary embodiment, the controller 101 includes processor circuitry that is configured to perform one or more operations and/or functions of the controller 101, including activating the actuators based on print data, and/or controlling to operation of the printer 100 (including controlling one or more components of the printer 100).

The print group 140 of the printer 100 thus includes at least one print bar 102 with K nozzles 21, 22 that may be activated with a defined line clock rate in order to print a line, which line travels transversal to the transport direction 1 of the recording medium 120, with K pixels or K columns 31, 32 of a print image onto the recording medium 120, for example with K>1000. In the depicted example, the nozzles 21, 22 are immobile or permanently installed in the printer 100, and the recording medium 120 is directed past the stationary nozzles 21, 22 with a defined transport velocity.

As presented above, the printer 100 may include a dryer 150 that is configured to dry the recording medium 120 after application of the ink by the one or more print bars 102, and therefore to fix the applied print image onto the recording medium 120. For this purpose, the dryer 150 may be controlled by a controller 101 of the printer 100. For example, the drying may take place depending on the quantity of the applied ink, and/or depending on a type of recording medium 120. For example, the temperature and/or the volumetric flow of the gaseous drying medium may be adapted depending on the quantity of applied ink per area or per area unit, and/or depending on a type of the recording medium 120.

The dryer 150 depicted in FIG. 1*b* includes a plurality of dryer elements 160 that are arranged along a drying route on both sides of the recording medium 120 (which is typically in the form of a web), and that are respectively configured to blow a gaseous drying medium, e.g. heated air, onto the surface of the recording medium 120. The print image on a recording medium 120 may thus be dried in a gentle and reliable manner along the drying route of the dryer 150. The drying energy and/or the drying performance of the individual dryer elements 160 may thereby be set individually. In the present disclosure, the dryer 150 can be referred to as a dryer system 150 that includes one or more dryers (i.e. dryer elements) 160.

FIG. 1*c* shows a block diagram with examples of components of a dryer element 160. The dryer element 160 depicted in FIG. 1*c* includes a blower 165 with which a gaseous medium, in particular air, may be directed past one or more heating elements 162.

Alternative or additional measures for generating a heated drying medium 164 are also possible (such as the use of a gas burner, for example). The drying medium 164 that is heated by the heating elements 162 is then blown onto the surface of the recording medium 120 via one or more openings or nozzles 163. The delivery rate of the blower 164, and/or the heating performance of the one or more heating elements 162, may be controlled or regulated via a controller 161 of the dryer element 160, and/or may be individually set, wherein the controller 161 may possibly be part of the controller 101 of the dryer 150 or of the printer 100. In particular, the temperature in the environment of the recording medium 120 may be recorded by means of a temperature sensor 166. The controller 161 may be configured to control or regulate the blower 164 and/or the one or more heating elements 162 depending on sensor data of the temperature sensor 166. For example, a defined temperature in the environment of the recording medium 120 may thus be set. In an exemplary embodiment, the controller 161 includes processor circuitry that is configured to perform one or more operations and/or functions of the controller 161, including controlling the dyer element (including one more components of the dryer element 161, such as the blower 164, heating element 162, etc.).

A contact-less float drying by means of a forced convection may thus be used to dry a recording medium 120. As is depicted in FIG. 1*b*, for this purpose the individual dryer elements 160 along the drying route are alternately arranged on the front side and the back side of the recording medium 120. The recording medium 120 may then be drawn or guided through the dryer 150, floating, past the dryer elements 160.

As has been presented above, an undulation of the printed and/or dried recording medium may be produced via the application of an ink-based print image and/or via the drying of the print image. The dimension of the undulation may thereby be reduced via reduction of the applied quantity of ink and/or of the drying temperature or drying energy that is used for the drying. However, this has the consequence that the color space available for a print image and the wear resistance of the print image are reduced.

FIG. 2*a* shows examples of components of an inkjet printer 100 via which the undulation of a printed and dried recording medium 120 may be influenced. A recording medium 120, in particular a recording medium 120 in the form of a web, is typically conveyed through the printer 100 with a defined mechanical (draw) tension. The tension of the recording medium 120 within the printer 100, in particular within the dryer 150, may be set by a tensioner, wherein the tensioner depicted in FIG. 2*a* includes a clamping point 201 arranged at the intake of the printer 100 and a clamping point 202 arranged at the output of the printer 100. A clamping point 201 or 202 may thereby have a pair of rollers between which the recording medium 120 may be clamped. The tension of the recording medium 120 within the printer 100 may be varied via adaptation of the rotation speeds of the roller pairs of the two clamping points 201, 202.

An additional variable influencing the undulation of a recording medium 120 that has been printed to is the drying of a print image printed onto the recording medium 120. One or more drying parameters may thereby be set or modified, in particular via the use of individually addressable dryer elements 160. Examples of drying parameters are

- the spatial and/or temporal distribution of the thermal drying energy used to dry a print image;
- a spatial and/or temporal distribution of the temperature along the drying route; and/or
- a drying on the front side and/or on the back side of a recording medium 120.

In an exemplary embodiment, the printer 100 includes a coater 130 that is configured to apply a coating substance onto the recording medium 120 before a print image is printed onto the coated recording medium 120. One or more coating parameters may thereby be adapted in order to reduce the undulation, or with the goal of reducing the undulation, of a recording medium 120 that has been printed to. Examples of coating parameters are

- a type or a composition of the coating substance; and/or
- a spatial distribution of the quantity of the coating substance applied onto the recording medium 120.

FIG. 2*b* illustrates that one or more operating parameters of the printer 100 may be adjusted in order to reduce the dimension 221 of the undulation of a recording medium 120. In particular, operating parameters may thereby be adjusted with regard to the (draw) tension 211 of the recording medium 120, in relation to the coating substance 212, and/or in relation to the thermal drying energy 214 that is introduced for drying. The one or more operating parameters may be adjusted depending on one or more boundary conditions. Examples of boundary conditions are properties of the ink 213 that is used and/or properties of the recording medium 120 that is used.

If applicable, an undulation of the recording medium 120 in a first direction (represented by the solid line on the right side of FIG. 2*b*) may be produced via specific values of one or more operating parameters and, if applicable, an undulation of the recording medium 120 in a second direction (represented by the dashed line on the right side of FIG. 2*b*) may be produced via specific values of one or more other operating parameters. The dimension 221 of the undulation of a printed and dried recording medium 120 may thus be reduced via a suitable combination of values.

In tests, it could be established that the web tension during the drying phase and/or the introduction of the heating power, from the printed side of the recording medium 120 and/or from the opposite side, has a significant effect on the undulation of the recording medium 120. The undulation may be significantly reduced by devices 201, 202 for monitoring the web tension 211 in the dryer 150, and/or by devices 160 for a single-sided action of drying heat. In particular, the flatness of a recording medium 120 that has been printed to may be improved in that a different influx of heat takes place from the one or more dryer elements 160 on the front side of the recording medium 120, and from the one or more dryer elements 160 on the back side of the recording medium 120. In order to increase the flatness of the printed recording medium 120, a greater heat influx may thereby preferably be produced on the printed front side of the recording medium 120 than on the unprinted back side of the recording medium 120. The heat may thereby be introduced via various methods, in particular via hot air convection and/or via radiant heat.

Alternatively or additionally, in an exemplary embodiment, the heat influx within the dryer 150 is adapted or set based on the printed recording medium 120, in particular depending on properties of the recording medium 120, in order to reduce the undulation of the printed recording medium 120. Alternatively or additionally, the web tension 211 in the dryer 150 may be adapted or set, depending on properties of the recording medium 120, in order to reduce the undulation of the printed recording medium 120.

In an exemplary embodiment, the printer 100 includes a sensor 203 that is configured to record sensor data with regard to the printed and dried recording medium 120. For example, the sensor data may indicate the amount of residual moisture in the recording medium 120. One or more of the operating parameters of the printer 100 that have an influence on the undulation of the recording medium 120 may be adapted or set depending on the sensor data. For example, the one or more operating parameters may be adapted such that the residual moisture of the recording medium 120 is adjusted, in particular is regulated, to a nominal moisture value. The undulation of the printed recording medium 120 may thus be reduced in a particularly reliable manner.

FIG. 3*a* shows a flowchart of a method 300 for reducing the undulation of a recording medium that has been printed to and dried by an inkjet printer according to an exemplary embodiment. The method may be executed by the controller 101 of an inkjet printer 100.

In an exemplary embodiment, the method 300 includes the determination 301 of boundary condition data. The boundary condition data may thereby indicate a property of the recording medium 120 and/or a property of a print image that has been or is to be printed onto the recording medium 120. The boundary condition data may in particular indicate a type of the recording medium 120 from a plurality of predefined types of recording media 120. Different types of recording media 120 may thereby have different properties with regard to the absorption capability and/or the degree of moisture. Alternatively or additionally, the boundary condition data may indicate a type of ink 213 used for the print image, from a plurality of predefined types of inks 213. Different inks 213 may thereby have a different proportion of water and/or different wetting properties and/or different flow properties, for example.

In an exemplary embodiment, the method 300 includes the setting 302 of at least one operating parameter of the printer 100 for a printing operation of the printer 100, depending on the boundary condition data, in order to reduce the undulation, or with the goal of reducing the undulation, of the recording medium 120 that has been printed to and dried during the printing operation. In other words: at least one operating parameter may be set and/or adapted such that the undulation of the recording medium 120 that has been printed to and dried during the printing operation is reduced (in comparison to a different setting of the at least one operating parameter).

In an exemplary embodiment, the at least one operating parameter of the printer 100 includes, for example: a quantity of drying energy 214 that acts on the recording medium 120 in the drying of said recording medium 120; a spatial and/or temporal distribution of the drying energy 214 in the drying of the recording medium 120; a mechanical (draw) tension 211 of the recording medium 120 during the printing operation of the printer 100, in particular during the drying of the printed recording medium 120; a property, in particular a composition, of a coating substance 212 that is applied in preparation for the printing of the print image onto the recording medium 120; and/or a quantity, in particular a spatial distribution of the quantity, of the applied coating substance 212.

A method 300 is thus described with which the undulation of a recording medium 120 that is printed to in an inkjet printer 100 may be reduced. Within the scope of the method 300, one or more operating parameters, in particular the applied drying energy 214 and/or the web tension 211 of the recording medium 120 during the drying of the recording medium 120, may thereby be set or adapted for or during the printing operation, so that the undulation of the printed and dried recording medium 120 is reduced, in particular is minimized.

In an exemplary embodiment, the at least one operating parameter of the printer 100 is set based on characteristic data, where the characteristic data may have been experimentally determined in advance. For different boundary condition data, the characteristic data may indicate different values of the at least one operating parameter via which the undulation of the recording medium 120 that has been printed to and dried during the printing operation is respectively reduced. For example, which values of the one or more operating parameters for different types of recording media 120 and/or for different types of inks 213 yield an optimally low or minimal undulation of the printed and dried recording medium 120 (at least statistically on average) may have been (experimentally) determined in advance. The undulation of a printed and dried recording medium 120 may be particularly reliably reduced via the consideration of characteristic data.

In an exemplary embodiment, the printer 100 includes a dryer 150 that is configured to apply drying energy 214 at a first side and at an opposite second side of the recording medium 120. If applicable, the drying energy 214 may thereby be individually set on each side of the recording medium 120. The boundary condition data may indicate whether the print image has been printed onto the first or the second side of the recording medium 120. The drying energy 214 that has been applied at the first side and/or the drying energy 214 that has been applied at the first side, and/or the drying power used for drying, may then be set depending on the boundary condition data. In particular, more drying energy 214 and/or a higher drying power may thereby be applied at the side of the recording medium 120 onto which the print image has been printed than onto the respective other side of the recording medium 120. The undulation of a printed and dried recording medium 120 may thus be particularly reliably reduced.

Alternatively or additionally, the mechanical (draw) tension 111 of the recording medium 120 within the printer 100, in particular with the dryer 150 of the printer 100, may be set depending on the boundary condition data (and possibly depending on characteristic data). The mechanical (draw) tension 111 that is produced on the recording medium 120 during the printing operation of the printer 100 may thereby be set. The undulation may be particularly comprehensively influenced, and in particular reduced, via the adjustment of the mechanical (draw) tension 111 of the recording medium 120.

In an exemplary embodiment, the printer 100 includes a coater 130 that is configured to apply a coating substance 212, in particular primer, onto the recording medium 120 in preparation for the printing of a print image. In an exemplary embodiment, the coating substance 212 is configured to modify the flow properties of ink 213 on the recording medium 120 (in order to generate an optimally sharp print image). The composition and/or the quantity of the applied coating substance 212 may be set depending on the boundary condition data (and if applicable depending on characteristic data). The undulation of a printed and dried recording medium 120 may thus be particularly reliably reduced.

In an exemplary embodiment, the printer 100 includes a sensor 203 (in particular a moisture sensor) that is configured to record sensor data with regard to the printed and dried recording medium 120. Within the scope of the method 300, at least one operating parameter of the printer 100 may then be adapted during the printing operation of the printer 100, depending on the sensor data, in order to reduce the undulation, or with the goal of reducing the undulation, of the recording medium 120 that has been printed to and dried during the printing operation. In particular, a control loop may be provided in order to (repeatedly and/or continuously) adjust the at least one operating parameter of the printer such that the undulation of the printed and dried recording medium 120 is reduced.

FIG. **3*b* shows a method 310 for reducing the undulation of a recording medium 120 that has been printed to and dried by an inkjet printer 100. The features that are described in conjunction with the method 300 may also be applied to the method 310 (and vice versa). The method 310 may be executed by the controller 101 of a printer 100**, for example.

In an exemplary embodiment, the method 310 includes the detection 311 of sensor data with regard to the printed and dried recording medium 120. The sensor data may be recorded by a sensor 203, in particular by a moisture sensor. The sensor data may indicate the moisture content of the printed and dried recording medium 120, for example. In particular, the sensor data may indicate a distribution of the moisture within the printed and dried recording medium 120 (e.g. along the thickness of the recording medium 120), from the first side (e.g. the front side) to the second side (e.g. the back side) of the recording medium 120; and/or along the surface extent of the recording medium 120.

Moreover, in an exemplary embodiment, the method 310 includes the adaptation 312 of at least one operating parameter of the printer 100 during a printing operation of the printer 100, depending on the sensor data, in order to reduce the undulation, or with the goal of reducing the undulation, of the recording medium 120 that has been printed to and dried during the printing operation. In other words, at least one operating parameter may be set and/or adapted such that the undulation of the recording medium 120 that has been printed to and dried during the printing operation is reduced (in comparison to a different setting of the at least one operating parameter). The undulation of the recording medium 120 that has been printed to and dried during the printing operation may be particularly reliably reduced via the consideration of sensor data.

Characteristic data (that have been determined in advance) may thereby be used that indicate different values of the at least one operating parameter for different occurrences of the sensor data.

In an exemplary embodiment, alternatively or additionally, the at least one operating parameter of the printer 100 may be adapted, depending on the sensor data, in order to set a property of the printed and dried recording medium 120, which property is indicated by the sensor data, to a predefined nominal value. In particular, a regulation of the property of the printed and dried recording medium 120, which property is indicated by the sensor data, to a predefined nominal value may take place.

The nominal value may thereby have been determined in advance, such that printed and dried recording media 120 that exhibit the predefined nominal value for the property (for example the moisture) indicated by the sensor data have—at least statistically, given a plurality of experiments—less of an undulation than printed and dried recording media 120 that have a (possibly arbitrary) value deviating from the predefined nominal value for the property indicated by the sensor data. If applicable, the undulation of the printed and dried recording medium 120 may be minimized by the nominal value (statistically, on average) in comparison to all possible values of the property indicated by the sensor data.

In an exemplary embodiment, the printer 100 is configured to execute at least one of the methods 300, 310 according one or more aspects described herein.

Via the measures described in this document, the flatness of a printed recording medium 120 may be improved without reducing the available color space or the wear resistance. The described measures may thereby be adapted to different types and/or properties of recording media 120.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM);

magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
21, 22 nozzle (print image)
31, 32 column (of the print image)
100 printer
101 controller
102 print bar
103 print head
120 recording medium
130 coater
140 print group
150 fixer or dryer
160 dryer element

161 controller
162 heating element
163 nozzle
164 tempered drying medium (air)
165 blower
166 temperature sensor
201, 202 clamping point (for adjustment of the draw tension in a recording medium)
203 sensor
211 tension
212 coating substance
213 ink
214 drying energy
221 dimension of the undulation
300, 310 method for reducing the undulation
301, 302, 311, 312 method steps

The invention claimed is:

1. A method for reducing undulation of a recording medium that has been printed to and dried by an inkjet printer, the method comprising:

determining boundary condition data that indicates whether a print image has been printed onto a first side and/or an opposite second side of the recording medium;

applying a drying energy, using a contactless float dryer of the printer, at the first side and/or the second side of the recording medium, based on the boundary condition data; and setting at least one operating parameter of the printer for a printing operation of the printer, based on the boundary condition data, in order to reduce the undulation of the recording medium printed to and dried during the printing operation, wherein the at least one operating parameter includes a tension of the recording medium within the printer.

2. The method according to claim 1, wherein more drying energy is applied to one of the first and the second sides of the recording medium onto which the print image has been printed than at the respective other side of the first and second sides of the recording medium.

3. The method according to claim 1, wherein the tension of the recording medium is set within the dryer based on the boundary condition data.

4. The method according to claim 1, wherein:

the printer comprises a coater that is configured to apply a coating substance onto the recording medium in preparation for a printing of a print image onto the recording medium; and a composition and/or a quantity of the applied coating substance is set based on the boundary condition data.

5. The method according to claim 1, wherein:

the at least one operating parameter is set based on characteristic data;

the characteristic data for different boundary condition data indicates different values of the at least one operating parameter via which the undulation of the recording medium that is printed to and dried during the printing operation is respectively reduced; and the characteristic data has been experimentally determined in advance.

6. The method according to claim 1, wherein:

the printer comprises a sensor that is configured to record sensor data corresponding to the printed and dried recording medium; and the method further comprises adaptation of the at least one operating parameter of the printer during the printing operation of said printer, based on the sensor data, to reduce the undulation of the recording medium printed to and dried during the printing operation.

7. The method according to claim 6, wherein the sensor comprises a moisture sensor configured to detect a moisture content of the printed and dried recording medium.

8. The method according to claim 7, wherein the sensor data indicates the moisture content of the printed and dried recording medium.

9. The method according to claim 6, wherein the sensor data indicates a moisture content of the printed and dried recording medium.

10. The method according to claim 6, wherein:

the at least one operating parameter of the printer is adapted, based on the sensor data, to adjust a property of the printed and dried recording medium to a predefined nominal value, the sensor data being indicative of the property; and the printed and dried recording medium that exhibits the predefined nominal value for the property exhibits less undulation than printed and dried recording medium exhibiting a value deviating from the predefined nominal value for the property.

11. A non-transitory computer-readable storage medium with an executable program stored thereon, that when executed, instructs a processor to perform the method of claim 1.

12. The method according to claim 1, wherein the contactless float dryer is configured to contactlessly provide the drying energy to the recording medium.

13. The method according to claim 1, wherein the tension of the recording medium is set within the dryer of the printer based on the boundary condition data.

14. A printer system comprising:

a printhead configured to print to the recording medium;

the dryer configured to dry the recording medium after printing; and a processor that is configured to perform the method of claim 1.

15. A printer for reducing undulation of a recording medium that has been printed to, the printer comprising:

a printhead configured to print to the recording medium;

a contactless float dryer configured to apply a drying energy to the recording medium, based on a boundary condition data, to dry the recording medium after printing; and a processor that is configured to:

determine the boundary condition data that indicates whether a print image has been printed onto a first side and/or an opposite second side of the recording medium by the printhead; and set at least one operating parameter of the printer for a printing operation of the printer, based on the boundary condition data, to reduce the undulation of the recording medium printed to and dried during the printing operation, wherein the at least one operating parameter includes a tension of the recording medium within the printer.

16. A method for reducing undulation of a recording medium that has been printed to and dried by an inkjet printer, the method comprising:

determining boundary condition data that indicates whether a print image has been printed onto a first side and/or an opposite second side of the recording medium;

applying a drying energy, using a contactless float dryer of the printer, at the first side and/or the second side of the recording medium, based on the boundary condition data;

recording sensor data corresponding to the printed and dried recording medium; and adapting at least one operating parameter of the inkjet printer during a printing operation of the inkjet printer, based on the sensor data, to reduce the undulation of the recording medium printed to and dried during the printing operation, wherein the at least one operating parameter includes a tension of the recording medium within the printer.

17. A non-transitory computer-readable storage medium with an executable program stored thereon, that when executed, instructs a processor to perform the method of claim 16.

18. A printer system comprising:

a printhead configured to print to the recording medium;

a dryer configured to dry the recording medium after printing; and a processor that is configured to perform the method of claim 16.

* * * * *